US007615928B2

(12) United States Patent
Lee et al.

(10) Patent No.: US 7,615,928 B2
(45) Date of Patent: Nov. 10, 2009

(54) LIGHT EMITTING DEVICE USING PLASMA DISCHARGE

(75) Inventors: Young-dong Lee, Gyeonggi-do (KR); Hidekazu Hatanaka, Gyeonggi-do (KR); Seung-hyun Son, Gyeonggi-do (KR); Jai-kwang Shin, Gyeonggi-do (KR); Young-mo Kim, Gyeonggi-do (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 485 days.

(21) Appl. No.: 11/179,727

(22) Filed: Jul. 13, 2005

(65) Prior Publication Data

US 2006/0170344 A1 Aug. 3, 2006

(30) Foreign Application Priority Data

Feb. 1, 2005 (KR) ..... 10-2005-0009109

(51) Int. Cl.
*H01J 17/49* (2006.01)

(52) U.S. Cl. ..... 313/587; 313/582; 313/584; 313/585; 313/586

(58) Field of Classification Search ..... 313/582–587
See application file for complete search history.

(56) References Cited

U.S. PATENT DOCUMENTS 6,525,470 B1 * 2/2003 Amemiya ..... 313/586
6,531,820 B1 * 3/2003 Lee et al. ..... 313/586
6,583,578 B1 * 6/2003 Ichihara et al. ..... 315/169.3
6,593,693 B1 * 7/2003 Takagi et al. ..... 313/586
6,995,512 B2 * 2/2006 Otani ..... 313/587
7,057,343 B2 * 6/2006 Fujitani ..... 313/586
7,239,086 B2 * 7/2007 Yuki et al. ..... 313/586
2003/0048241 A1 * 3/2003 Shin et al. ..... 345/60
2003/0193291 A1 * 10/2003 Im et al. ..... 313/582

FOREIGN PATENT DOCUMENTS

JP 2001-015038 A 1/2001
JP 2002150944 A * 5/2002
KR 10-2001-0039031 * 5/2001
KR 2001-0077686 A 8/2001

OTHER PUBLICATIONS

Machine English translation of KR 10-2001-0039031.*
Korean Office Action dated Jul. 25, 2006 (with English translation of category of cited documents).

* cited by examiner

*Primary Examiner*—Sikha Roy
(74) *Attorney, Agent, or Firm*—Harness, Dickey & Pierce, P.L.C.

(57) ABSTRACT

A plasma-discharge light emitting device is provided. The plasma-discharge light emitting device may include: rear and front panels separated from each other in a predetermined interval, wherein at least one discharge cell may be provided between the rear and front panels, and wherein plasma discharge may be generated in the discharge cells; a pair of discharge electrodes provided on at least one of the rear and front panels for each of the discharge cells; a trench provided as a portion of each of the discharge cells between the pair of the discharge electrodes; and electron-emitting material layers provided on both sidewalls of the trench.

19 Claims, 8 Drawing Sheets

LIGHT EMITTING DEVICE USING PLASMA DISCHARGE

CROSS-REFERENCE TO RELATED PATENT APPLICATION

This application claims the benefit of Korean Patent Application No. 10-2005-0009109, filed on Feb. 1, 2005, in the Korean Intellectual Property Office, the disclosure of which is incorporated herein in its entirety by reference

BACKGROUND OF THE DISCLOSURE

1. Field of the Disclosure

Embodiments of the present disclosure may include a light emitting device using plasma discharge, and more particularly, a light emitting device using plasma discharge capable of reducing discharge voltage and improving luminous efficiency.

2. Description of the Related Art

In a light emitting device using plasma discharge (hereinafter, referred to as a plasma-discharge light emitting device), the plasma discharge is generated by a direct-current (DC) or alternating-current (AC) voltage applied between two electrodes, ultraviolet (UV) light generated during the discharge process excites fluorescent materials, and an image is formed by using visible light emitting from the fluorescence materials. Among the plasma-discharge light emitting devices, there are plasma display panel (PDP) and a flat lamp which is used for a black-light of a liquid crystal display (LCD).

The plasma-discharge light emitting device is classified into DC and AC types. In the DC type light emitting device, all electrodes are exposed to a discharge space, and discharge is generated by electrical charges directly moving between electrodes. In the AC type light emitting device, at least one electrode is covered with a dielectric layer, and discharge is generated by wall charges instead of the electrical charges directly moving between the electrodes.

In addition, the plasma-discharge light emitting device is classified into facing and surface discharge types. In the facing discharge light emitting device, a pair of two sustaining electrodes provided on front and rear substrates, facing each other, and discharge is generated in a direction perpendicular to the substrates. In the surface discharge light emitting device, a pair of sustaining electrodes is provided on the same substrate, and discharge is generated in a direction parallel to the substrate.

Although it has high luminous efficiency, the facing discharge light emitting device has a disadvantage that its fluorescent layer can be easily deteriorated due to plasma. Therefore, the surface discharge light emitting device has been mainly used.

FIGS. 1 and 2 illustrate a conventional surface discharge plasma display panel. In FIG. 2, only the front substrate is illustrated in a 90°-rotated state in order to clearly show an internal structure of the plasma display panel.

Referring to FIGS. 1 and 2, the conventional plasma display panel includes rear and front substrates 10 and 20 facing each other. The space between the rear and front substrates 10 and 20 is a discharge space where the plasma discharge is generated.

A plurality of address electrodes 11 are provided on an upper surface of the rear substrate 10. The address electrodes 11 are buried in a first dielectric layer 12. A plurality of barrier ribs 13 partitioning the discharge space are provided on an upper of the first dielectric layer 12 to partition the discharge space. In addition, the barrier ribs 13 are provided in a predetermined interval on the upper surface of the first dielectric layer 12 in order to prevent electrical or optical crosstalk between the discharge cells 14. The discharge cells 14 are filled with a discharge gas which is generally a mixture of Ne and Xe. Fluorescent layers having a predetermined thickness are coated on inner walls of the discharge cells 14, that is, the upper surface of the first dielectric layer 12 and side surfaces of the barrier ribs 13.

The front substrate 20 is a transparent substrate, which is mainly made of glass capable of passing visible light. The front substrate 20 is coupled with the rear substrate 10 provided with the barrier ribs 13. On a lower surface of the front substrate 20, there are provided pairs of sustain electrodes 21*a* and 21*b* in a direction perpendicular to the address electrodes 11. The sustain electrodes 21*a* and 21*b* are mainly made of a transparent, conductive material such as indium tin oxide (ITO) capable of passing the visible light. On lower surfaces of the sustain electrodes 21*a* and 21*b*, there are provided bus electrodes 22*a* and 22*b*, made of metal, having a narrower width than those of the sustain electrodes 12*a* and 12*b* in order to reduce line resistance thereof. The sustain electrodes 21*a* and 21*b* and bus electrodes 22*a* and 22*b* are buried in a second dielectric layer 23, which is a transparent layer. A protective layer 24 is provided on a lower surface of the second dielectric layer 23. The protective layer 24 functions as preventing damage to the second dielectric layer 23 due to sputtered plasma particles and reducing discharge voltage by emitting secondary electrons. In general, the protective layer 24 is made of MgO.

In the plasma display panel, the luminous efficiency can be improved by increasing a Xe partial pressure. However, in this case, there is a problem of increase in the discharge voltage. In addition, the luminous efficiency can be improved by widening a distance between the sustaining electrodes 21*a* and 21*b* to elongate a discharge path. However, in this case, there is a problem of increase in the discharge voltage.

SUMMARY OF THE DISCLOSURE

Embodiments of the present disclosure may provide a plasma-discharge light emitting device capable of reducing discharge voltage and improving luminous efficiency.

According to an aspect of the present disclosure, there may be provided a plasma-discharge light emitting device comprising: rear and front panels separated from each other in a predetermined interval, wherein at least one discharge cell may be provided between the rear and front panels, and wherein plasma discharge may be generated in the discharge cells; a pair of discharge electrodes provided on at least one of the rear and front panels for each of the discharge cells; a trench provided as a portion of each of the discharge cells between the pair of the discharge electrodes; and an electron-emitting material layer provided on a sidewall of the trench.

In the aspect of the present disclosure, the electron-emitting material layer may be made of OPPS (oxidized porous polysilicon). In addition, the plasma-discharge light emitting device may further comprise a grid electrode provided on the electron-emitting material layer.

In addition, the electron-emitting material layer may be made of CNT (carbon nanotube).

According to another aspect of the present disclosure, there may be provided a plasma display panel comprising: rear and front substrate separated from each other in a predetermined interval, wherein a plurality of discharge cells may be provided between the rear and front substrates, and wherein plasma discharge may be generated in the discharge cells; a plurality of barrier ribs provided between the rear and front substrates to partition a space between the rear and front substrates and define the discharge cells; a plurality of address electrodes provided on an upper surface of the rear substrate; a first dielectric layer provided on the upper surface of the rear substrate to bury the address electrodes; a pair of sustain electrodes provided on a lower surface of the front substrate for each of the discharge cells; a second dielectric layer provided on the lower surface of the front substrate to bury the sustain electrode, wherein a trench may be provided as a portion of each of the discharge cells between the pair of the sustain electrodes; electron-emitting material layers provided on both sidewalls of the trench; and a fluorescent layer formed on an inner wall of each of the discharge cells.

According to still another aspect of the present disclosure, there may be provided a flat lamp comprising: rear and front substrate separated from each other in a predetermined interval, wherein at least one discharge cell may be provided between the rear and front substrates, and wherein plasma discharge may be generated in the discharge cells; a pair of discharge electrodes provided on an inner surface of at least one of the rear and front substrates for each of the discharge cells; a dielectric layer provided on the inner surface of each of the substrates where the discharge electrodes are provided, wherein the dielectric layer buries the discharge electrodes, wherein a trench may be provided as a portion of each of each of the discharge cells between the pair of the discharge electrodes; electron-emitting material layers provided on both of sidewalls of the trench; and a fluorescent layer formed on an inner wall of each of the discharge cells. In the aspect of the present disclosure, the flat lamp may further comprise at least one spacer, wherein the spacers partition a space between the rear and front substrates to define the discharge cells.

According to further still another aspect of the present disclosure, there may be provided flat lamp comprising: rear and front substrate separated from each other in a predetermined interval, wherein at least one discharge cell may be provided between the rear and front substrates, and wherein plasma discharge may be generated in the discharge cells; a pair of discharge electrodes provided on an outer surface of at least one of the rear and front substrates for each of the discharge cells; a trench provided as a portion of each of the discharge cells on an inner portion of the substrate between the pair of the discharge electrodes; electron-emitting material layers provided on both of sidewalls of the trench; and a fluorescent layer formed on an inner wall of each of the discharge cells.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF EXEMPLARY EMBODIMENTS OF THE DISCLOSURE

Now, the preferred embodiments of the present disclosure will be described in detail with reference to the accompanying drawings.

A plasma-discharge light emitting device according to the present disclosure may include a plasma display panel and a flat lamp. Firstly, embodiments of the plasma display panel according to the present disclosure will be described. In FIGS. 3, 5, 6 and 7, only the front substrate is illustrated in a 90°-rotated state in order to clearly show an internal structure of the plasma display panel.

Figure 1:
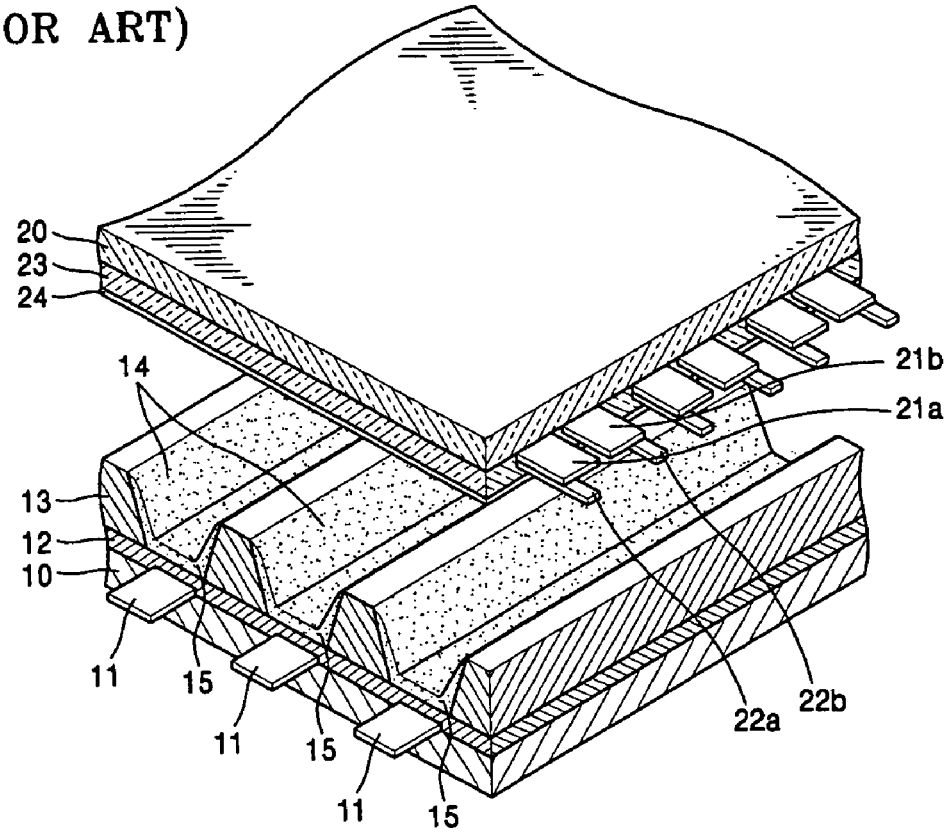
FIG. 1 (PRIOR ART)
FIG. 1 is a perspective view illustrating a conventional surface discharge plasma display panel.
Figure 2:
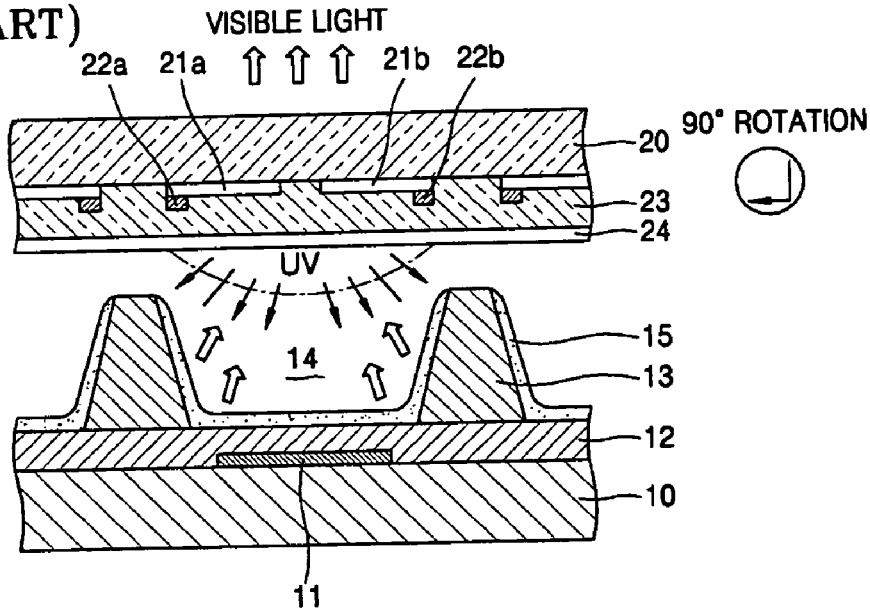
FIG. 2 (PRIOR ART)
FIG. 2 is a cross sectional view of the conventional surface discharge plasma display panel of FIG. 1.
Figure 3:
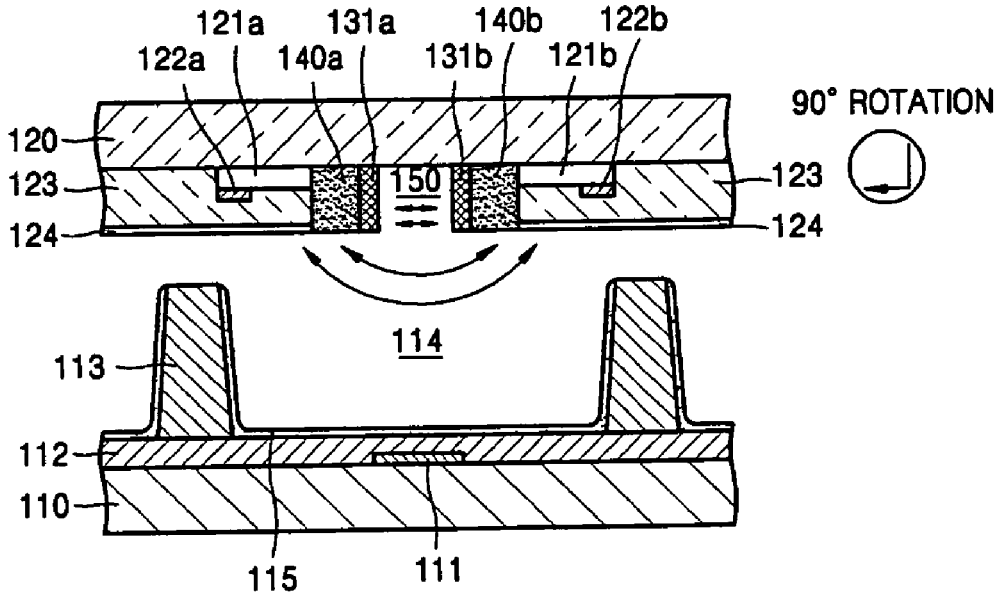
FIG. 3 is a cross sectional view of a plasma display panel according to a first embodiment of the present disclosure.

FIG. 3 is a cross sectional view of a plasma display panel according to a first embodiment of the present disclosure. The plasma display panel may include rear and front panels separated from each other in a predetermined interval. A plurality of barrier ribs 113 may be provided between the rear and front panels. The barrier ribs 113 partition a space between rear and front panels to form a plurality of discharge cells 114 where plasma discharge may be generated. In addition, the barrier ribs 113 prevent electrical and optical crosstalk between adjacent discharge cells 114. The discharge cells 114 may be filled with a discharge gas emitting ultraviolet (UV) light at the plasma discharge. The discharge gas may be generally a mixture of Ne and Xe. Red (R), green (G) and blue (B) fluorescent layers 115 having a predetermined thickness may be coated on inner walls of the respective discharge cells 114. The UV light generated by the discharge may excite the fluorescent layers 115. In turn, the fluorescent layers 115 may emit visible light in respective colors.

The rear panel may include a rear substrate 110, a plurality of address electrodes 111 formed on an upper surface of the rear substrate 110, and a first dielectric layer 112 formed on the upper surface of the rear substrate 110 to bury the address electrodes 111. In general, the rear substrate 110 may be a glass substrate. The address electrodes 111 formed on the upper surface of the rear substrate 110 may be parallel to each other. The address electrode 111 is buried by the first dielectric layer 112.

The barrier ribs 113 provided on an upper surface of the first dielectric layer 112 may be parallel to the address electrodes 111 and separated from each other in a predetermined interval. The fluorescent layers 115 having a predetermined thickness may be provided on the upper surface of the first dielectric layer 112 and the sidewalls of the barrier ribs 113.

The front panel may include a front substrate 120 separated from the rear substrate 110 in a predetermined interval, a plurality of pairs of first and second sustain electrodes 121*a* and 121*b* provided for the respective discharge cells 114 on a lower surface of the front substrate 120, and a second dielectric layer 123 provided on the lower surface of the front substrate 120 to bury the first and second sustain electrodes 121*a* and 121*b*.

In general, the front substrate 120 may be a glass substrate capable of passing visible light. On the lower surface of the front substrate 120, there may be provided pairs of the first and second sustain electrodes 121*a* and 121*b* for the respective discharge cells 114 in a direction intersecting the address electrodes 111. Here, the first and second sustain electrodes 121*a* and 121*b* may be mainly made of a transparent conductive material such as indium tin oxide (ITO). On a lower surface of the first and second sustain electrodes 121*a* and 121*b*, there may be provided bus electrodes 122*a* and 122*b* in order to reduce line resistance of the first and second sustain electrodes 121*a* and 121*b*. The bus electrodes 122*a* and 122*b* having a narrower width than the first and second sustain electrodes 121*a* and 121*b* may be provided along edge portions of the first and second sustain electrodes 121*a* and 121*b*. Here, the bus electrodes 122*a* and 122*b* may be preferably made of a metallic material such as Al and Ag. The first and second sustain electrodes 121*a* and 121*b* and the bus electrodes 122*a* and 122*b* may be buried with the second dielectric layer 123, which is made of a transparent material.

A trench 150 having a predetermined width may be provided on the second dielectric layer 123 between the first and second sustain electrodes 121*a* and 121*b*. The trench 150 may be formed as a portion of each of the discharge cells 114. The trench 150 may be parallel to the first and second sustain electrodes 121*a* and 121*b*. Since the trench 150 may be provided on the second dielectric layer 123 between the first and second sustain electrodes 121*a* and 121*b*, an electric field may be effectively concentrated on an inner portion of the trench 150, so that the discharge voltage can be reduced.

On the other hand, first and second electron-emitting material layers 140*a* and 140*b* having a predetermined thickness may be provided on the respective sidewalls of the trench 150. Preferably, the first and second electron-emitting material layers 140*a* and 140*b* may be made of oxidized porous polysilicon (OPPS) capable of accelerating and emitting electrons outwardly. In addition, first and second grid electrodes 131*a* and 131*b* may be provided on the respective first and second electron-emitting material layers 140*a* and 140*b*. The first grid electrode 131*a* may be an electrode for accelerating electrons in the first electron-emitting material layer 140*a* toward the trench 150 by using a voltage difference between the first grid electrode 131*a* and the first sustain electrode 121*a*. The second grid electrode 131*b* may be an electrode for accelerating electrons in the second electron-emitting material layer 140*b* toward the trench 150 by using a voltage difference between the second sustain electrode 121*b* and the second grid electrode 131*b*.

A protective layer 124 made of MgO may be provided on a lower surface of the second dielectric layer 123. The protective layer 124 may have a function of preventing damage to the second dielectric layer 123 due to sputtering of plasma particles. In addition, the protective layer 124 may have a function of reducing a discharge voltage by emitting secondary electrons.

In the plasma display panel, an AC voltage may be applied between the first and second sustain electrodes 121*a* and 121*b* to generate the plasma discharge in the discharge cells 114.

Figure 4:
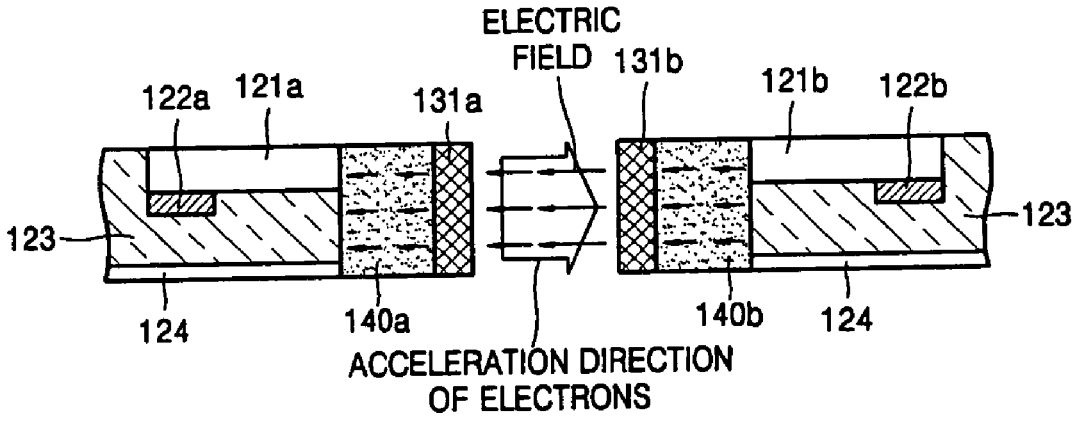
FIG. 4 shows an electric field formed in a trench in the plasma display panel of FIG. 3 and an acceleration direction of electrons under the electric field.

Referring to FIG. 4, in the plasma display panel according to the embodiment, when a predetermined first voltage may be applied between the first and second sustain electrodes 121*a* and 121*b*, the first and second sustain electrodes 121*a* and 121*b* serve as cathode and anode electrodes, respectively. FIG. 4 shows an electric field formed in the trench 150 and an acceleration direction of the electrons under the electric field. The strong electric field may be generated in the trench 150 in the direction from the second sustain electrode 121*b* to the first sustain electrode 121*a*. Due to the strong electric field, the discharge may be primarily generated in the trench 150, and after that, the discharge spreads over the entire region of the discharge cell 114. The electrons accelerated from the first electron-emitting material layer 140*a* may be emitted and accelerated into the strong electric field of the trench 150 toward the second sustain electrode 121*b*. Here, a predetermined voltage may be applied to the first grid electrode 131*a*, so that the electrons can be emitted and accelerated from the first electron-emitting material layer 140*a* due to the voltage difference between the first grid electrode 131*a* and the first sustain electrode 121*a*.

Next, when a predetermined second voltage is applied between the first and second sustain electrodes 121*a* and 121*b*, the first and second sustain electrodes 121*a* and 121*b* may serve as anode and cathode electrodes, respectively. A strong electric field may be generated in the trench 150 in the direction from the first sustain electrode 121*a* to the second sustain electrode 121*b*, so that the discharge may be generated in the trench 150. The electrons accelerated from the second electron-emitting material layer 140*b* may be emitted into the strong electric field of the trench 150 toward the first sustain electrode 121*a*. Here, a predetermined voltage may be applied to the second grid electrode 131*b*, so that the electrons may be emitted and accelerated from the second electron-emitting material layer 140*b* due to the voltage difference between the second grid electrode 131*b* and the second sustain electrode 121*b*.

Like this, in the plasma display panel, when a predetermined AC voltage is applied between the first and second sustain electrodes 121*a* and 121*b*, the discharge may be primarily generated in the trench 150, and after that, the discharge may spread over the entire regions of the discharge cell 114. Due to the strong electric field generated in the trench 150, the discharge may be generated by using a low voltage. Therefore, it is possible to reduce a discharge voltage. In addition, due to predetermined voltages applied to the first and second grid electrodes 131*a* and 131*b*, the electrons accelerated from the first and second electron-emitting material layers 140*a* and 140*b* may be alternately emitted into the strong electric field of the trench 150. As a result, the plasma discharge can be efficiently generated by the emitted electrons, so that it is possible to improve brightness and luminous efficiency.

Figure 5:
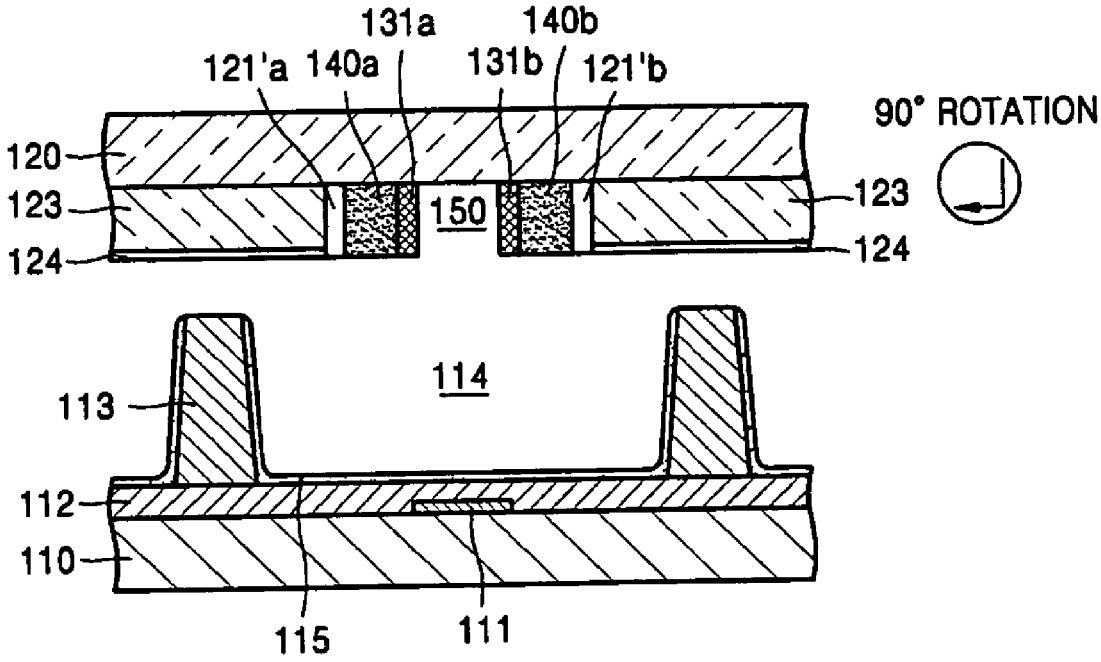
FIG. 5 is a cross sectional view of a modified example of the plasma display panel according to the first embodiment of the present disclosure.

FIG. 5 shows a modified example of the plasma display panel according to the first embodiment of the present invention. In the modified example, first and second sustain electrodes 121*a*' and 121*b*' may be provided facing to the first and second grid electrodes 131*a* and 131*b*, respectively.

Figure 6:
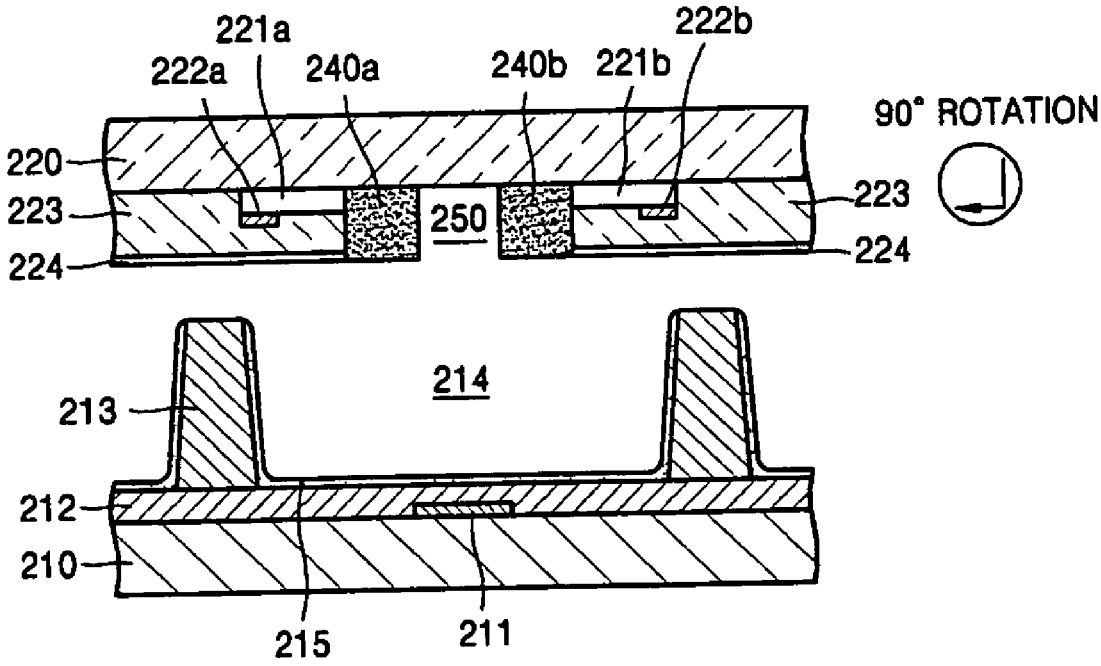
FIG. 6 is a cross sectional view of a plasma display panel according to a second embodiment of the present disclosure.

FIG. 6 is a cross sectional view of a plasma display panel according to a second embodiment of the present invention. The plasma display panel may include rear and front panels separated from each other in a predetermined interval. A plurality of barrier ribs 213 defining discharge cells 114 may be provided between the rear and front panels. The discharge cells 214 may be filled with a discharge gas emitting UV light. Fluorescent layers 215 having a predetermined thickness may be coated on inner walls of the respective discharge cells 214.

The rear panel may include a rear substrate 210, a plurality of address electrodes 211 formed on an upper surface of the rear substrate 210, and a first dielectric layer 212 formed on the upper surface of the rear substrate 210 to bury the address electrodes 211.

The front panel may include a front substrate 220 separated from the rear substrate 210 in a predetermined interval, a plurality of pairs of first and second sustain electrodes 221*a* and 221*b* provided for the respective discharge cells 214 on a lower surface of the front substrate 220, and a second dielectric layer 223 provided on the lower surface of the front substrate 220 to bury the first and second sustain electrodes 221*a* and 221*b*. On a lower surface of the first and second sustain electrodes 221*a* and 221*b*, there may be provided bus electrodes 222*a* and 222*b*. The first and second sustain electrodes 221*a* and 221*b* and the bus electrodes 222*a* and 222*b* may be buried with the second dielectric layer 223, which may be made of a transparent material.

A trench 250 may be provided on the second dielectric layer 223 between the first and second sustain electrodes 221*a* and 221*b*. As described above, due to the trench 250, an electric field may be effectively concentrated on an inner portion of the trench 250, so that the discharge voltage may be reduced.

First and second electron-emitting material layers 240*a* and 240*b* having a predetermined thickness may be provided on the respective sidewalls of the trench 250. The first and second electron-emitting material layers 240*a* and 240*b* may be made of oxidized porous polysilicon (OPPS) capable of accelerating and emitting electrons outwardly. A protective layer 224 made of MgO may be provided on a lower surface of the second electric layer 223.

Like this, in the plasma display panel, when a predetermined AC voltage is applied between the first and second sustain electrodes 221*a* and 221*b*, the discharge is primarily generated in the trench 250, and after that, the discharge may spread over the entire regions of the discharge cell 214. Due to the AC voltage applied between the first and second sustain electrodes 221*a* and 221*b*, the electrons accelerated from the first and second electron-emitting material layers 240*a* and 240*b* may be alternately emitted into the strong electric field of the trench 250.

Figure 7:
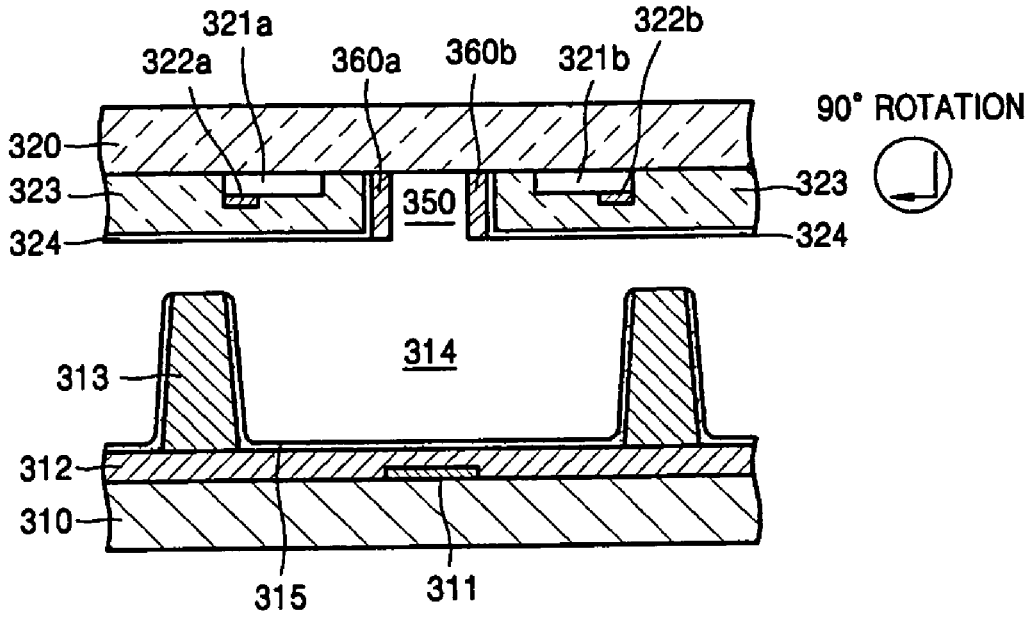
FIG. 7 is a cross sectional view of a plasma display panel according to a third embodiment of the present disclosure.

FIG. 7 is a cross sectional view of a plasma display panel according to a third embodiment of the present disclosure. The plasma display panel may include rear and front panels separated from each other in a predetermined interval. A plurality of barrier ribs 313 defining discharge cells 314 may be provided between the rear and front panels. The discharge cells 314 may be filled with a discharge gas emitting UV light. Fluorescent layers 315 having a predetermined thickness may be coated on inner walls of the respective discharge cells 314. The rear panel may include a rear substrate 310, a plurality of address electrodes 311 formed on an upper surface of the rear substrate 310, and a first dielectric layer 312 formed on the upper surface of the rear substrate 310 to bury the address electrodes 311. The front panel may include a front substrate 320 separated from the rear substrate 310 in a predetermined interval, a plurality of pairs of first and second sustain electrodes 321*a* and 321*b* provided for the respective discharge cells 314 on a lower surface of the front substrate 320, and a second dielectric layer 323 provided on the lower surface of the front substrate 320 to bury the first and second sustain electrodes 321*a* and 321*b*. On a lower surface of the first and second sustain electrodes 321*a* and 321*b*, there may be provided bus electrodes 322*a* and 322*b*. The first and second sustain electrodes 321*a* and 321*b* and the bus electrodes 322*a* and 322*b* may be buried with the second dielectric layer 323, which may be made of a transparent material.

A trench 350 may be provided on the second dielectric layer 323 between the first and second sustain electrodes 321*a* and 321*b*. First and second electron-emitting material layers 340*a* and 340*b* may be provided on the respective sidewalls of the trench 350. Preferably, the first and second electron-emitting material layers 360*a* and 360*b* may be made of carbon nanotube (CNT) capable of emitting a large number of electrons into the trench 350. A protective layer 324 made of MgO may be provided on a lower surface of the second electric layer 323.

Figure 8:
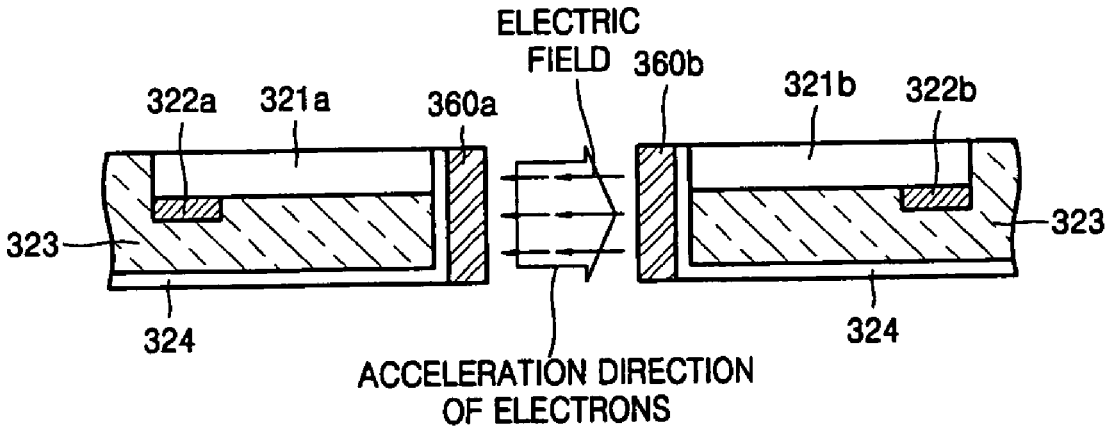
FIG. 8 shows an electric field formed in a trench in the plasma display panel of FIG. 7 and an acceleration direction of electrons under the electric field.

Referring to FIG. 8, in the plasma display panel according to the embodiment, when a predetermined first voltage is applied between the first and second sustain electrodes 321*a* and 321*b*, the first and second sustain electrodes 321*a* and 321*b* may serve as cathode and anode electrodes, respectively. FIG. 8 shows an electric field formed in the trench 350 and an acceleration direction of the electrons under the electric field. The strong electric field may be generated in the trench 350 in the direction from the second sustain electrode 321*b* to the first sustain electrode 321*a*. Due to the strong electric field, the discharge may be primarily generated in the trench 350, and after that, the discharge spreads over the entire region of the discharge cell 314. A large number of the electrons emitted from the first electron-emitting material layer 360*a* may be accelerated into the strong electric field of the trench 350 toward the second sustain electrode 321*b*.

Next, when a predetermined second voltage is applied between the first and second sustain electrodes 321*a* and 321*b*, the first and second sustain electrodes 321*a* and 321*b* may serve as anode and cathode electrodes, respectively. A strong electric field may be generated in the trench 350 in the direction from the first sustain electrode 321*a* to the second sustain electrode 321*b*, so that the discharge may be generated in the trench 350. A large number of the electrons emitted from the second electron-emitting material layer 360*b* may be accelerated into the strong electric field of the trench 350 toward the first sustain electrode 321*a*.

Like this, in the plasma display panel, when a predetermined AC voltage is applied between the first and second sustain electrodes 321*a* and 321*b*, the discharge may be primarily generated in the trench 350, and after that, the discharge may spread over the entire regions of the discharge cell 314. Due to the strong electric field generated in the trench 350, the discharge may be generated by using a low voltage. Therefore, it may be possible to reduce a discharge voltage. In addition, due to the predetermined AC voltages applied between the first and second sustain electrodes 321*a* and 321*b*, a large number of the electrons emitted from the first and second electron-emitting material layers 340*a* and 340*b* may be alternately accelerated into the strong electric field of the trench 350. As a result, the plasma discharge may be efficiently generated by the accelerated electrons, so that it may be possible to improve brightness and luminous efficiency.

Figure 9:
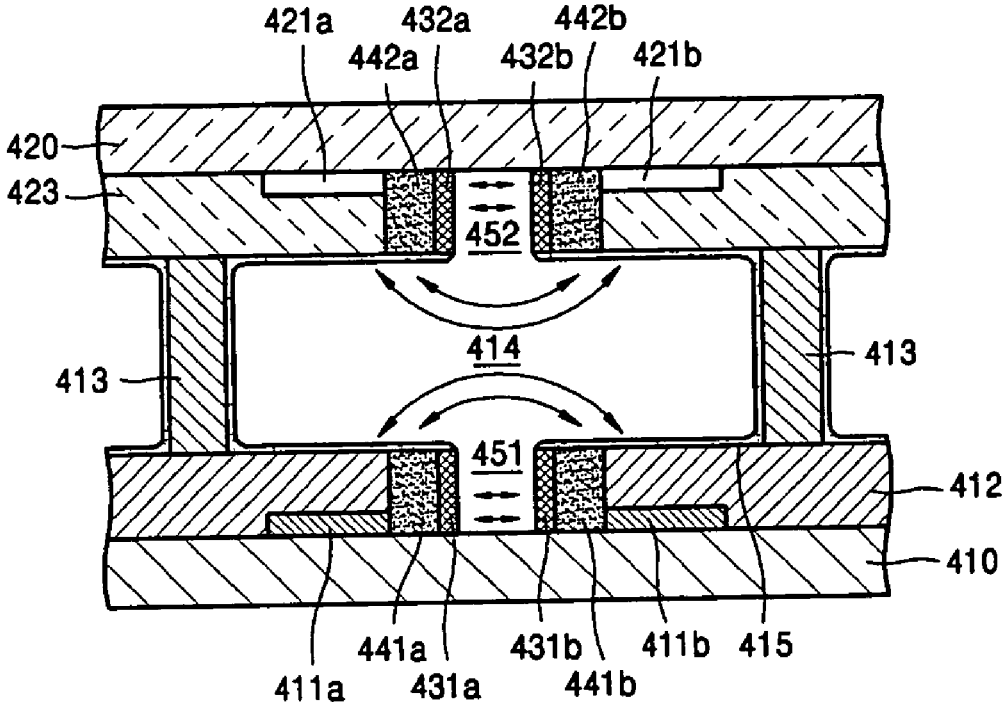
FIG. 9 is a cross sectional view of a flat lamp according to a fourth embodiment of the present disclosure.

Now, a flat lamp according to an embodiment of the present disclosure will be described. FIG. 9 is a cross sectional view of a flat lamp according to the fourth embodiment of the present disclosure. The flat lamp may include rear and front panels separated from each other in a predetermined interval. Between the rear and front panels, there may be provided at least one discharge cell 414 where plasma discharge may be generated. In addition, between the rear and front panels, there may be provided at least one spacer 413 which supports the rear and front panels and partitions the space between the rear and front panels to define the discharge cells 414. The discharge cells 414 may be filled with a discharge gas emitting ultraviolet (UV) light at the plasma discharge. Fluorescent layers 415 having a predetermined thickness may be coated on inner walls of the respective discharge cells 414.

The rear panel includes a rear substrate 410, a plurality of pairs of first and second discharge electrodes 411*a* and 411*b* formed for the respective discharge cells 414 on an upper surface of the rear substrate 410, and a first dielectric layer 412 formed on the upper surface of the rear substrate 410 to bury the first and second discharge electrodes 411*a* and 411*b*. A first trench 451 may be provided on the first dielectric layer 412 between the first and second discharge electrodes 411*a* and 411*b*. The first trench 451 may be formed as a portion of each of the discharge cells 414. The first trench 451 may be parallel to the first and second discharge electrodes 411*a* and 411*b*.

First and second electron-emitting material layers 441*a* and 441*b* may be provided on the respective sidewalls of the first trench 451. Preferably, the first and second electron-emitting material layers 441*a* and 441*b* may be made of OPPS capable of accelerating and emitting electrons outwardly. In addition, first and second grid electrodes 431*a* and 431*b* may be provided on the respective first and second electron-emitting material layers 441*a* and 441*b*. The first grid electrode 431*a* may be an electrode for accelerating electrons in the first electron-emitting material layer 441*a* toward the first trench 451 by using a voltage difference between the first grid electrode 431*a* and the first discharge electrode 411*a*. The second grid 411*b* may be an electrode for accelerating electrons in the second electron-emitting material layer 441*b* toward the first trench 451 by using a voltage difference between the second grid electrode 431*b* and the second discharge electrode 411*b*. The front panel may include a front substrate 420 separated from the rear substrate 410 in a predetermined interval, a plurality of pairs of third and fourth discharge electrodes 421*a* and 421*b* formed for the respective discharge cells 414 on a lower surface of the front substrate 420, and a second dielectric layer 423 formed on the lower surface of the front substrate 420 to bury the third and fourth discharge electrodes 421*a* and 421*b*. A second trench 452 may be provided on the second dielectric layer 423 between the third and fourth discharge electrodes 421*a* and 421*b*. The second trench 452 may be formed as a portion of each of the discharge cells 414. The second trench 452 may be parallel to the third and fourth discharge electrodes 421*a* and 421*b*.

Third and fourth electron-emitting material layers 442*a* and 442*b* may be provided on the respective sidewalls of the second trench 452. Preferably, the third and fourth electron-emitting material layers 442*a* and 442*b* may be made of OPPS capable of accelerating and emitting electrons outwardly. In addition, third and fourth grid electrodes 432*a* and 432*b* may be provided on the respective third and fourth electron-emitting material layers 442*a* and 442*b*. The third grid electrode 432*a* may be an electrode for accelerating electrons in the third electron-emitting material layer 442*a* toward the second trench 452 by using a voltage difference between the third grid electrode 432*a* and the third discharge electrode 421*a*. The fourth grid electrode 421*b* may be an electrode for accelerating electrons in the fourth electron-emitting material layer 442*b* toward the second trench 452 by using a voltage difference between the fourth grid electrode 421*b* and the fourth discharge electrode 421*b*.

In the flat lamp according to the embodiment, when predetermined AC voltages are applied between the first and second discharge electrodes 411*a* and 411*b* and between the third and fourth discharge electrodes 421*a* and 421*b*, the discharge may be primarily generated in the first and second trenches 451 and 452, and after that, the discharge may spread over the entire region of the discharge cell 414. Due to a strong electric field generated in the first and second trenches 451 and 452, the discharge may be generated by using a low voltage. Therefore, it is possible to reduce a discharge voltage. In addition, due to predetermined voltages applied to the first and second grid electrodes 431*a* and 431*b*, the electrons accelerated from the first and second electron-emitting material layers 441*a* and 441*b* may be alternately emitted into the strong electric field of the first trench 451. In addition, due to predetermined voltages applied to the third and fourth grid electrodes 432*a* and 432*b*, the electrons accelerated from the third and fourth electron-emitting material layers 442*a* and 442*b* may be alternately emitted into the strong electric field of the second trench 452. As a result, the plasma discharge may be efficiently generated by the emitted electrons, so that it is possible to improve brightness and luminous efficiency.

Figure 10:
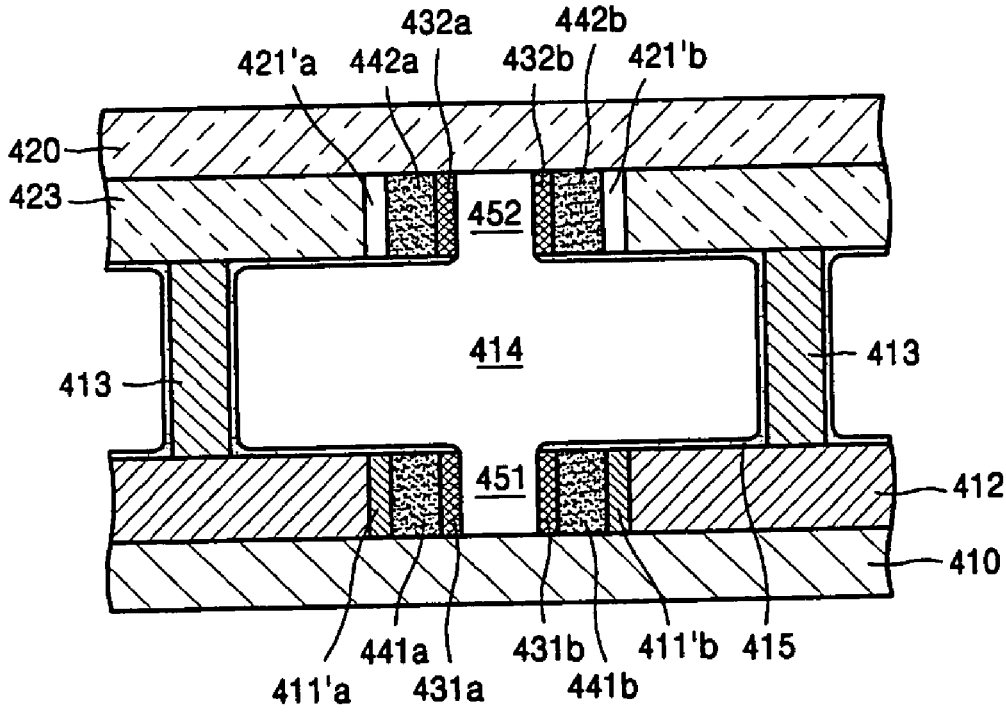
FIG. 10 is a cross sectional view of a flat lamp according to an modified example of the fourth embodiment of the present disclosure.

FIG. 10 shows a modified example of the flat lamp according to the fourth embodiment. In the modified example, first and second discharge electrodes 411*a*' and 411*b*' may be provided facing the first and second grid electrodes 431*a* and 431*b*, respectively; and third and fourth discharge electrodes 421*a*' and 421*b*' may be provided facing the third and fourth grid electrodes 432*a* and 432*b*.

Figure 11:
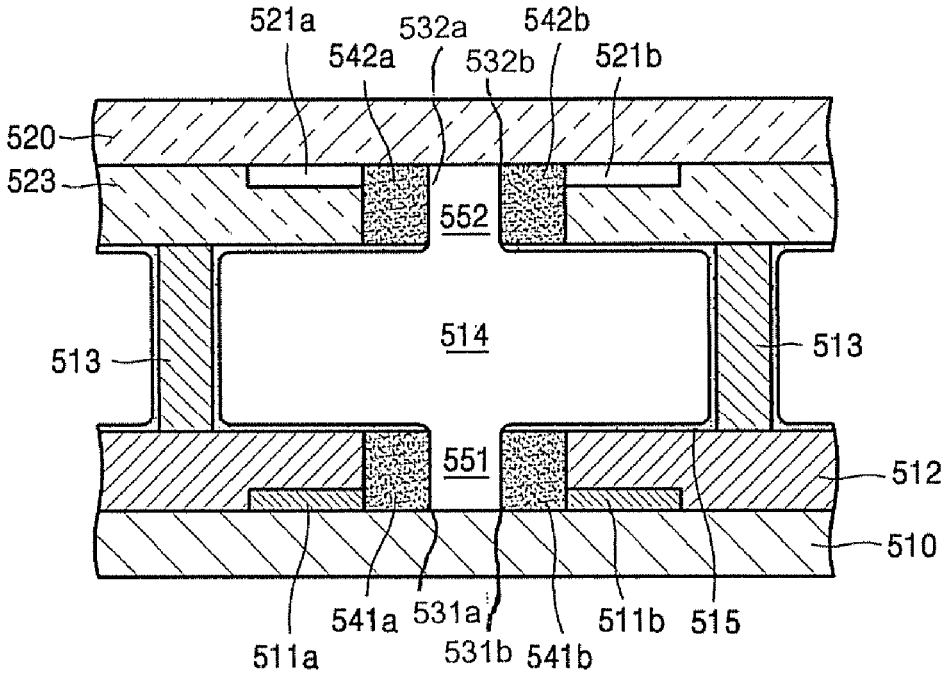
FIG. 11 is a cross sectional view of a flat lamp according to a fifth embodiment of the present disclosure.

FIG. 11 is a cross sectional view of a flat lamp according to a fifth embodiment of the present invention. The flat lamp may include rear and front panels separated from each other in a predetermined interval. Between the rear and front panels, there may be provided at least one discharge cell 514 where plasma discharge may be generated. In addition, between the rear and front panels, there may be provided at least one spacer 513 which supports the rear and front panels and partitions the space between the rear and front panels to define the discharge cells 514. The discharge cells 514 may be filled with a discharge gas emitting UV light at the plasma discharge. Fluorescent layers 515 having a predetermined thickness may be coated on inner walls of the respective discharge cells 514.

The rear panel may include a rear substrate 510, a plurality of pairs of first and second discharge electrodes 511*a* and 511*b* formed for the respective discharge cells 514 on an upper surface of the rear substrate 510, and a first dielectric layer 512 formed on the upper surface of the rear substrate 510 to bury the first and second discharge electrodes 511*a* and 511*b*. A first trench 551 may be provided on the first dielectric layer 512 between the first and second discharge electrodes 511*a* and 511*b*. First and second electron-emitting material layers 541*a* and 541*b* may be provided on the respective sidewalls of the first trench 551. Preferably, the first and second electron-emitting material layers 541*a* and 541*b* may be made of OPPS.

The front panel includes a front substrate 520 separated from the rear substrate 510 in a predetermined interval, a plurality of pairs of third and fourth discharge electrodes 521*a* and 521*b* formed for the respective discharge cells 514 on a lower surface of the front substrate 520, and a second dielectric layer 523 formed on the lower surface of the front substrate 520 to bury the third and fourth discharge electrodes 521*a* and 521*b*. A second trench 552 may be provided on the second dielectric layer 523 between the third and fourth discharge electrodes 521*a* and 521*b*. Third and fourth electron-emitting material layers 542*a* and 542*b* may be provided on the respective sidewalls of the second trench 552. Preferably, the third and fourth electron-emitting material layers 542*a* and 542*b* may be made of OPPS.

In the flat lamp according to the embodiment, when predetermined AC voltages are applied between the first and second discharge electrodes 511*a* and 511*b* and between the third and fourth discharge electrodes 521*a* and 521*b*, the discharge may be primarily generated in the first and second trenches 551 and 552, and after that, the discharge may spread over the entire region of the discharge cell 514. Due to predetermined voltages applied to the first and second grid electrodes 531*a* and 531*b*, the electrons accelerated from the first and second electron-emitting material layers 541*a* and 541*b* may be alternately emitted into the strong electric field of the first trench 551. In addition, due to predetermined voltages applied to the third and fourth grid electrodes 532*a* and 532*b*, the electrons accelerated from the third and fourth electron-emitting material layers 542*a* and 542*b* may be alternately emitted into the strong electric field of the second trench 552. As a result, the plasma discharge may be efficiently generated by the emitted electrons, so that it may be possible to improve brightness and luminous efficiency.

Figure 12:
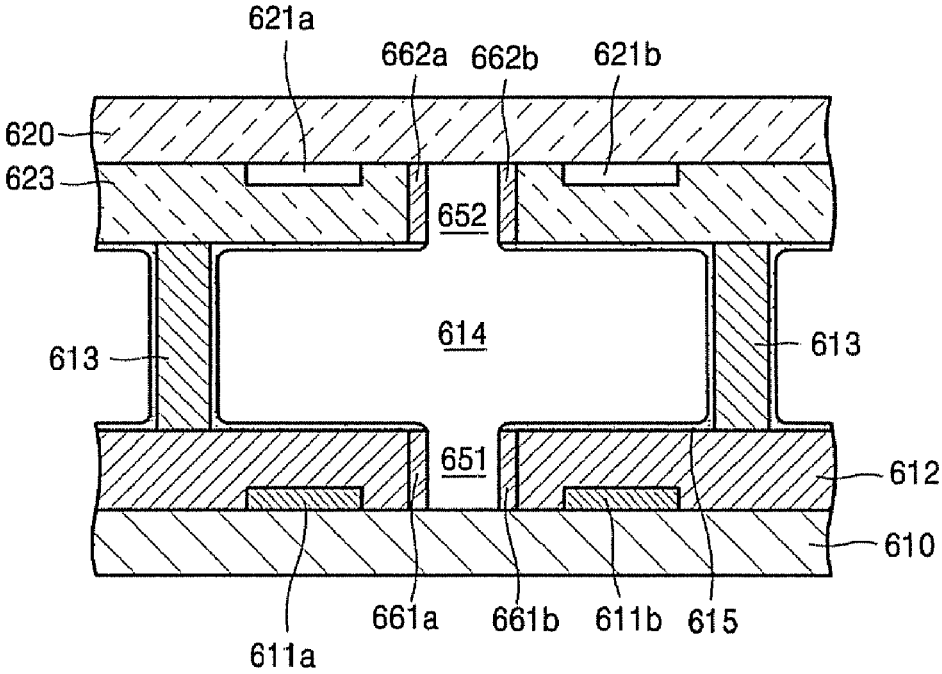
FIG. 12 is a cross sectional view of a flat lamp according to a sixth embodiment of the present disclosure.

FIG. 12 is a cross sectional view of a flat lamp according to a sixth embodiment of the present invention. The flat lamp includes rear and front panels separated from each other in a predetermined interval. Between the rear and front panels, there may be provided at least one discharge cell 614 where plasma discharge may be generated. In addition, between the rear and front panels, there may be provided at least one spacer 613 which supports the rear and front panels and partitions the space between the rear and front panels to define the discharge cells 614. The discharge cells 614 may be filled with a discharge gas emitting UV light at the plasma discharge. Fluorescent layers 615 having a predetermined thickness may be coated on inner walls of the respective discharge cells 614.

The rear panel may include a rear substrate 610, a plurality of pairs of first and second discharge electrodes 611*a* and 611*b* formed for the respective discharge cells 614 on an upper surface of the rear substrate 610, and a first dielectric layer 612 formed on the upper surface of the rear substrate 610 to bury the first and second discharge electrodes 611*a* and 611*b*. A first trench 651 may be provided on the first dielectric layer 612 between the first and second discharge electrodes 611*a* and 611*b*. First and second electron-emitting material layers 641*a* and 641*b* may be provided on the respective sidewalls of the first trench 651. Preferably, the first and second electron-emitting material layers 641*a* and 641*b* may be made of CNT capable of emitting a large number of electrons into the first trench 651.

The front panel includes a front substrate 620 separated from the rear substrate 610 in a predetermined interval, a plurality of pairs of third and fourth discharge electrodes 621*a* and 621*b* formed for the respective discharge cells 614 on a lower surface of the front substrate 620, and a second dielectric layer 623 formed on the lower surface of the front substrate 620 to bury the third and fourth discharge electrodes 621*a* and 621*b*. A second trench 652 may be provided on the second dielectric layer 623 between the third and fourth discharge electrodes 621*a* and 621*b*. Third and fourth electron-emitting material layers 642*a* and 642*b* may be provided on the respective sidewalls of the second trench 652. Preferably, the third and fourth electron-emitting material layers 642*a* and 642*b* may be made of CNT capable of emitting a large number of electrons into the second trench 652.

In the flat lamp according to the embodiment, when predetermined AC voltages are applied between the first and second discharge electrodes 611*a* and 611*b* and between the third and fourth discharge electrodes 621*a* and 621*b*, the discharge may be primarily generated in the first and second trenches 651 and 652, and after that, the discharge may spread over the entire region of the discharge cell 614. Due to the predetermined AC voltages applied between the first and second discharge electrodes 611*a* and 611*b*, a large number of the electrons emitted from the first and second electron-emitting material layers 641*a* and 641*b* may be alternately accelerated into the strong electric field of the first trench 651. In addition, due to the predetermined AC voltages applied the third and fourth discharge electrodes 621*a* and 621*b*, a large number of the electrons accelerated from the third and fourth electron-emitting material layers 642*a* and 642*b* can be alternately accelerated into the strong electric field of the second trench 652. As a result, the plasma discharge may be efficiently generated by the accelerated electrons, so that it is possible to improve brightness and luminous efficiency.

Figure 13:
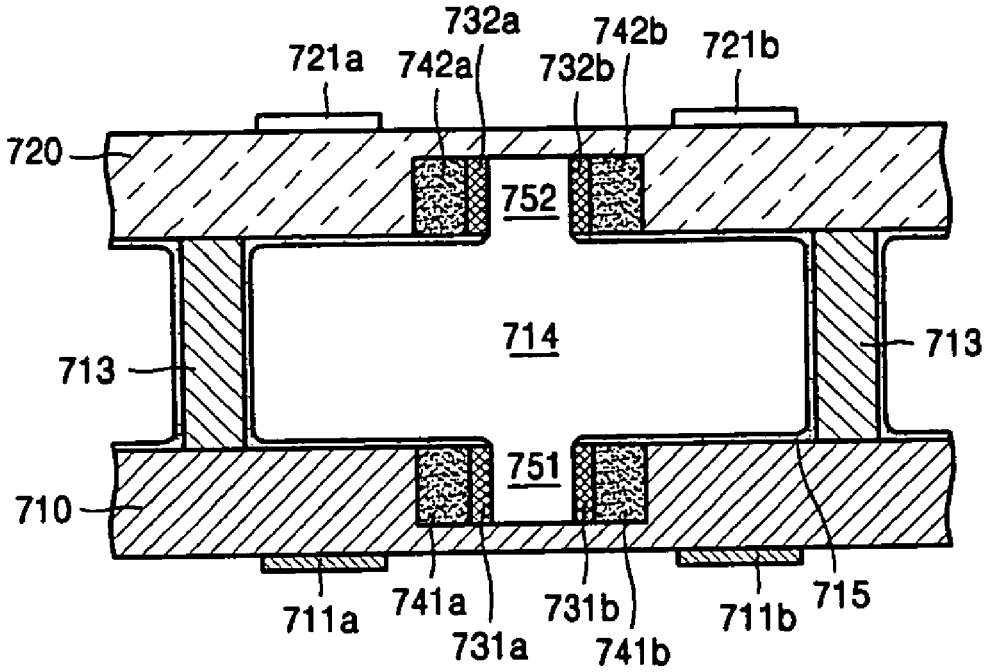
FIG. 13 is a cross sectional view of a flat lamp according to a seventh embodiment of the present disclosure.

FIG. 13 is a cross sectional view of a flat lamp according to a seventh embodiment of the present disclosure. The flat lamp may include rear and front panels separated from each other in a predetermined interval. Between the rear and front panels, there may be provided at least one discharge cell 714 where plasma discharge may be generated. In addition, between the rear and front panels, there may be provided at least one spacer 713 which supports the rear and front panels and partitions the space between the rear and front panels to define the discharge cells 714. The discharge cells 714 may be filled with a discharge gas emitting ultraviolet (UV) light at the plasma discharge. Fluorescent layers 715 having a predetermined thickness may be coated on inner walls of the respective discharge cells 714.

The rear panel may include a rear substrate 710 and a plurality of pairs of first and second discharge electrodes 711*a* and 711*b* formed for the respective discharge cells 714 on a lower surface of the rear substrate 710. A first trench 751 having a predetermined depth may be provided on an upper portion of the rear substrate 710 between first and second discharge electrodes 711*a* and 711*b*. The first trench 751 may be formed as a portion of each of the discharge cells 714. The first trench 751 may be parallel to the first and second discharge electrodes 711*a* and 711*b*.

First and second electron-emitting material layers 741*a* and 741*b* having a predetermined thickness may be provided on the respective sidewalls of the first trench 751. Preferably, the first and second electron-emitting material layers 741*a* and 741*b* may be made of OPPS capable of accelerating and emitting electrons outwardly. In addition, first and second grid electrodes 731*a* and 731*b* may be provided on the respective first and second electron-emitting material layers 741*a* and 741*b*. The first grid electrode 731*a* may be an electrode for accelerating electrons in the first electron-emitting material layer 741*a* toward the first trench 751 by using a voltage difference between the first grid electrode 731*a* and the first discharge electrode 711*a*. The second grid 711*b* may be an electrode for accelerating electrons in the second electron-emitting material layer 741*b* toward the first trench 751 by using a voltage difference between the second grid electrode 731*b* and the second discharge electrode 711*b*.

The front panel includes a front substrate 720 separated from the rear substrate 710 in a predetermined interval and a plurality of pairs of third and fourth discharge electrodes 721*a* and 721*b* formed for the respective discharge cells 714 on an upper surface of the front substrate 720. A second trench 752 having a predetermined depth may be provided on a lower portion of the front substrate 720 between the third and fourth discharge electrodes 721*a* and 721*b*. The second trench 752 may be formed as a portion of each of the discharge cells 714. The second trench 752 may be parallel to the third and fourth discharge electrodes 721*a* and 721*b*.

Third and fourth electron-emitting material layers 742*a* and 742*b* having a predetermined thickness may be provided on the respective sidewalls of the second trench 752. Preferably, the third and fourth electron-emitting material layers 742*a* and 742*b* are made of OPPS capable of accelerating and emitting electrons outwardly. In addition, third and fourth grid electrodes 732*a* and 732*b* may be provided on the respective third and fourth electron-emitting material layers 742*a* and 742*b*. The third grid electrode 732*a* may be an electrode for accelerating electrons in the third electron-emitting material layer 742*a* toward the second trench 752 by using a voltage difference between the third grid electrode 732*a* and the third discharge electrode 721*a*. The fourth grid electrode 721*b* may be an electrode for accelerating electrons in the fourth electron-emitting material layer 742*b* toward the second trench 752 by using a voltage difference between the fourth grid electrode 721*b* and the fourth discharge electrode 721*b*.

In the flat lamp according to the embodiment, when predetermined AC voltages are applied between the first and second discharge electrodes 711*a* and 711*b* and between the third and fourth discharge electrodes 721*a* and 721*b*, the discharge may be primarily generated in the first and second trenches 751 and 752, and after that, the discharge spreads over the entire region of the discharge cell 714. Due to a strong electric field generated in the first and second trenches 751 and 752, the discharge may be generated by using a low voltage. Therefore, it is possible to reduce a discharge voltage. In addition, due to predetermined voltages applied to the first and second grid electrodes 731*a* and 731*b*, the electrons accelerated from the first and second electron-emitting material layers 741*a* and 741*b* may be alternately emitted into the strong electric field of the first trench 751. In addition, due to predetermined voltages applied to the third and fourth grid electrodes 732*a* and 732*b*, the electrons accelerated from the third and fourth electron-emitting material layers 742*a* and 742*b* may be alternately emitted into the strong electric field of the second trench 752. As a result, the plasma discharge may be efficiently generated by the emitted electrons, so that it may be possible to improve brightness and luminous efficiency.

Figure 14:
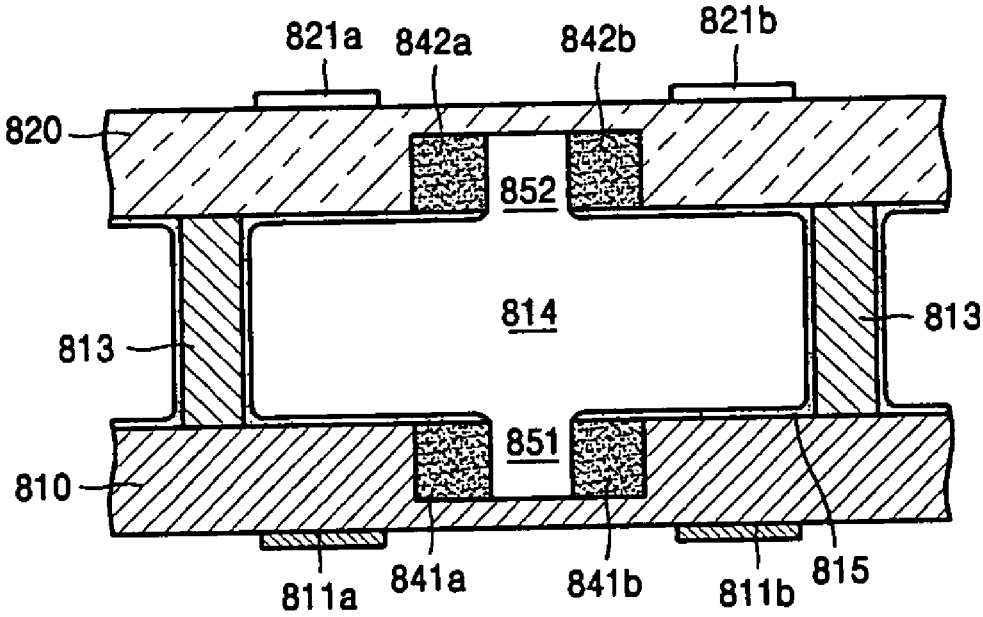
FIG. 14 is a cross sectional view of a flat lamp according to an eighth embodiment of the present disclosure.

FIG. 14 is a cross sectional view of a flat lamp according to an eighth embodiment of the present disclosure. The flat lamp includes rear and front panels separated from each other in a predetermined interval. Between the rear and front panels, there may be provided at least one discharge cell 814 where plasma discharge may be generated. In addition, between the rear and front panels, there may be provided at least one spacer 813 which may support the rear and front panels and partitions the space between the rear and front panels to define the discharge cells 814. The discharge cells 814 may be filled with a discharge gas emitting ultraviolet (UV) light at the plasma discharge. Fluorescent layers 815 having a predetermined thickness may be coated on inner walls of the respective discharge cells 814.

The rear panel includes a rear substrate 810 and a plurality of pairs of first and second discharge electrodes 811*a* and 811*b* formed for the respective discharge cells 814 on a lower surface of the rear substrate 810. A first trench 851 may be provided on an upper portion of the rear substrate 810 between first and second discharge electrodes 811*a* and 811*b*. First and second electron-emitting material layers 841*a* and 841*b* having a predetermined thickness may be provided on the respective sidewalls of the first trench 851. Preferably, the first and second electron-emitting material layers 841*a* and 841*b* may be made of OPPS capable of accelerating and emitting electrons outwardly.

The front panel may include a front substrate 820 separated from the rear substrate 810 in a predetermined interval and a plurality of pairs of third and fourth discharge electrodes 821*a* and 821*b* formed for the respective discharge cells 814 on an upper surface of the front substrate 820. A second trench 852 may be provided on lower portion of the front substrate 820 between the third and fourth discharge electrodes 821*a* and 821*b*. Third and fourth electron-emitting material layers 842*a* and 842*b* having a predetermined thickness may be provided on the respective sidewalls of the second trench 852. Preferably, the third and fourth electron-emitting material layers 842*a* and 842*b* may be made of OPPS capable of accelerating and emitting electrons outwardly.

In the flat lamp according to the embodiment, when predetermined AC voltages are applied between the first and second discharge electrodes 811*a* and 811*b* and between the third and fourth discharge electrodes 821*a* and 821*b*, the discharge may be primarily generated in the first and second trenches 851 and 852, and after that, the discharge may spread over the entire region of the discharge cell 814. Due to the predetermined AC voltages applied between the first and second discharge electrodes 811*a* and 811*b*, the electrons accelerated from the first and second electron-emitting material layers 841*a* and 841*b* may be alternately emitted into the first trench 851. In addition, due to the predetermined VC voltages applied between the third and fourth discharge electrodes 821*a* and 821*b*, the electrons accelerated from the third and fourth electron-emitting material layers 842*a* and 842*b* may be alternately emitted into the second trench 852. As a result, the plasma discharge may be efficiently generated by the emitted electrons, so that it may be possible to improve brightness and luminous efficiency.

Figure 15:
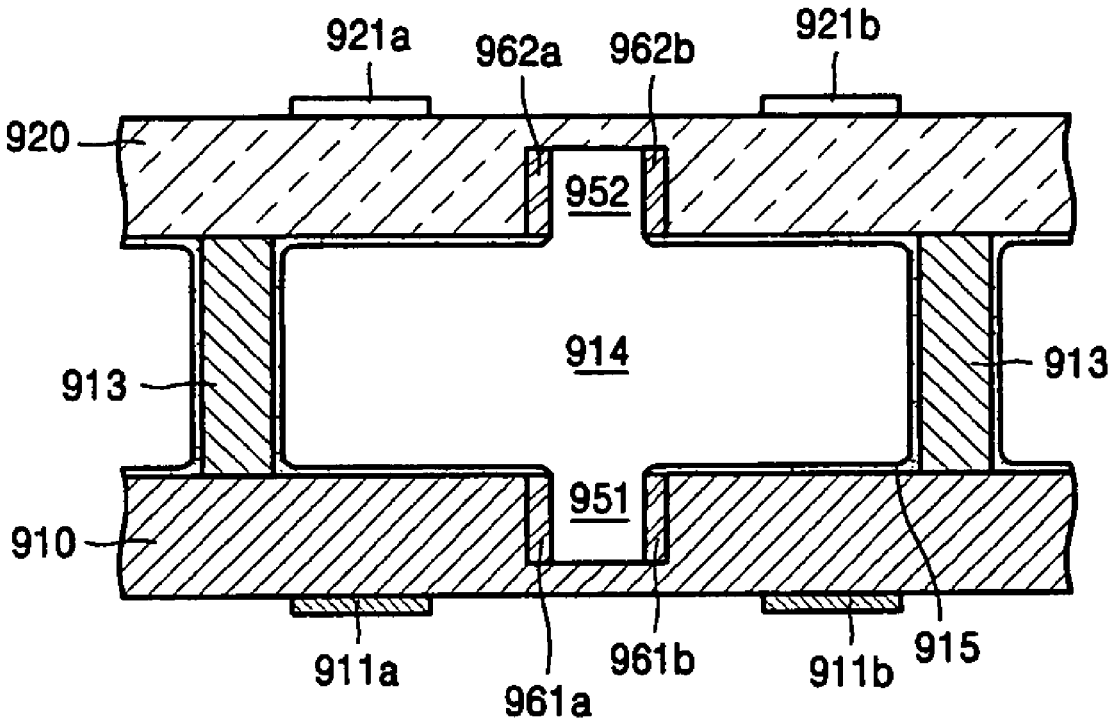
FIG. 15 is a cross sectional view of a flat lamp according to a ninth embodiment of the present disclosure.

FIG. 15 is a cross sectional view of a flat lamp according to a ninth embodiment of the present disclosure. The flat lamp may include rear and front panels separated from each other in a predetermined interval. Between the rear and front panels, there may be provided at least one discharge cell 914 where plasma discharge may be generated. In addition, between the rear and front panels, there may be provided at least one spacer 913 which supports the rear and front panels and partitions the space between the rear and front panels to define the discharge cells 914. The discharge cells 914 may be filled with a discharge gas emitting ultraviolet (UV) light at the plasma discharge. Fluorescent layers 915 having a predetermined thickness may be coated on inner walls of the respective discharge cells 914.

The rear panel may include a rear substrate 910 and a plurality of pairs of first and second discharge electrodes 911*a* and 911*b* formed for the respective discharge cells 914 on a lower surface of the rear substrate 910. A first trench 951 may be provided on an upper portion of the rear substrate 910 between first and second discharge electrodes 911*a* and 911*b*. First and second electron-emitting material layers 961*a* and 961*b* may be provided on the respective sidewalls of the first trench 951. The first and second electron-emitting material layers 961*a* and 961*b* may be made of CNT capable of emitting a large number of electrons into the first trench 951

The front panel may include a front substrate 920 separated from the rear substrate 910 in a predetermined interval and a plurality of pairs of third and fourth discharge electrodes 921*a* and 921*b* formed for the respective discharge cells 914 on an upper surface of the front substrate 920. A second trench 952 may be provided on lower portion of the front substrate 920 between the third and fourth discharge electrodes 921*a* and 921*b*. Third and fourth electron-emitting material layers 962*a* and 962*b* may be provided on the respective sidewalls of the second trench 952. Preferably, the third and fourth electron-emitting material layers 962*a* and 962*b* are made of CNT capable of emitting a large number of electrons into the second trench 952.

In the flat lamp according to the embodiment, when predetermined AC voltages are applied between the first and second discharge electrodes 911*a* and 911*b* and between the third and fourth discharge electrodes 921*a* and 921*b*, the discharge may be primarily generated in the first and second trenches 951 and 952, and after that, the discharge may spread over the entire region of the discharge cell 914. Due to the predetermined AC voltages applied between the first and second discharge electrodes 911*a* and 911*b*, a large number of the electrons emitted from the first and second electron-emitting material layers 961*a* and 961*b* may be alternately accelerated into the first trench 951. In addition, due to the predetermined VC voltages applied between the third and fourth discharge electrodes 921*a* and 921*b*, a large number of the electrons emitted from the third and fourth electron-emitting material layers 962*a* and 962*b* may be alternately accelerated into the second trench 952. As a result, the plasma discharge may be efficiently generated by the accelerated electrons, so that it is possible to improve brightness and luminous efficiency.

In the flat lamps of the aforementioned embodiments, a pair of discharge electrodes may be provided to both of the rear and front substrates. However, not limited thereto, the discharge electrodes may be one of the rear and front substrate.

A trench may be provided between a pair of discharge electrodes, so that it may be possible to concentrate an electric field on an inner portion of the trench. Therefore, discharge may be generated by using a low voltage, so that it may be possible to reduce a discharge voltage. In addition, there may be provided an electron-emitting material layer capable of emitting accelerated electrons or a large number of electrons into a strong electric field of the trench, so that the plasma discharge may be efficiently generated. Therefore, it may be possible to improve brightness and luminous efficiency.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. A plasma-discharge light emitting device comprising:

rear and front panels, comprising rear and front substrates, separated from each other in a predetermined interval, wherein at least one discharge cell is provided between the rear and front panels, and wherein plasma discharge is generated in the discharge cells;

a pair of discharge electrodes provided on at least one of the rear and front panels for each of the discharge cells;

a trench provided as a portion of each of the discharge cells between the pair of the discharge electrodes, wherein the bottom surface of the trench is said rear or front substrate; and electron-emitting material layers provided on both sidewalls of the trench, and capable of accelerating and emitting electrodes outwardly.

2. The plasma-discharge light emitting device according to claim 1, wherein the electron-emitting material layers comprise OPPS (oxidized porous polysilicon).

3. The plasma-discharge light emitting device according to claim 2, further comprising grid electrodes provided on the electron-emitting material layers.

4. The plasma-discharge light emitting device according to claim 1, wherein the electron-emitting material layers comprise CNT (carbon nanotube).

5. A plasma display panel comprising:

rear and front substrate separated from each other in a predetermined interval, wherein a plurality of discharge cells are provided between the rear and front substrates, and wherein plasma discharge is generated in the discharge cells;

a plurality of barrier ribs provided between the rear and front substrates to partition a space between the rear and front substrates and define the discharge cells;

a plurality of address electrodes provided on an upper surface of the rear substrate;

a first dielectric layer provided on the upper surface of the rear substrate to bury the address electrodes;

a pair of sustain electrodes provided on a lower surface of the front substrate for each of the discharge cells;

a second dielectric layer provided on the lower surface of the front substrate to bury the sustain electrode, wherein a trench is provided as a portion of each of the discharge cells between the pair of the sustain electrodes, wherein the bottom surface of the trench is said front substrate;

electron-emitting material layers provided on both sidewalls of the trench, and capable of accelerating and emitting electrodes outwardly; and a fluorescent layer formed on an inner wall of each of the discharge cells.

6. The plasma display panel according to claim 5, wherein the trench is parallel to the sustain electrodes.

7. The plasma display panel according to claim 5, wherein each of the electron-emitting material layer comprises OPPS (oxidized porous polysilicon).

8. The plasma display panel according to claim 7, further comprising grid electrodes provided on the respective electron-emitting material layers.

9. The plasma display panel according to claim 8, wherein the sustain electrode is disposed adjacent to the electron-emitting material, and wherein the electron-emitting material and the grid electrode face each other.

10. The plasma display panel according to claim 5, wherein the electron-emitting material layers comprise CNT (carbon nanotube).

11. The plasma display panel according to claim 5, further comprising bus electrodes provided on lower surfaces of the respective sustains electrodes.

12. The plasma display panel according to claim 5, further comprising a protective layer provided on the second dielectric layer.

13. A flat lamp comprising:

rear and front substrate separated from each other in a predetermined interval, wherein at least one discharge cell is provided between the rear and front substrates, and wherein plasma discharge is generated in the discharge cells;

a pair of discharge electrodes provided on an inner surface of at least one of the rear and front substrates for each of the discharge cells;

a dielectric layer provided on the inner surface of each of the substrates where the discharge electrodes are provided, wherein the dielectric layer buries the discharge electrodes, wherein a trench is provided as a portion of each of each of the discharge cells between the pair of the discharge electrodes, wherein the bottom surface of the trench is said rear or front substrate;

electron-emitting material layers provided on both of sidewalls of the trench, and capable of accelerating and emitting electrodes outwardly; and a fluorescent layer formed on an inner wall of each of the discharge cells.

14. The flat lamp according to claim 13, wherein the trench is parallel to the discharge electrodes.

15. The flat lamp according to claim 13, wherein the electron-emitting material layers comprise OPPS (oxidized porous polysilicon).

16. The flat lamp according to claim 15, further comprising grid electrodes provided on the respective electron-emitting material layers.

17. The flat lamp according to claim 16, wherein each of the discharge electrodes is disposed adjacent to the electron-emitting material, and wherein the electron-emitting material and the grid electrode face each other.

18. The flat lamp according to claim 13, wherein the electron-emitting material layers comprise CNT (carbon nanotube).

19. The flat lamp according to claim 13, further comprising at least one spacer, wherein the spacers partition a space between the rear and front substrates to define the discharge cells.

* * * * *